United States Patent [19]

Brewer

[11] Patent Number: 4,689,828

[45] Date of Patent: Sep. 1, 1987

[54] PROTECTIVE DEVICE FOR HAIR STYLIST'S FINGERS

[76] Inventor: Janet C. Brewer, 506 Clay St., La Porte, Ind. 46350

[21] Appl. No.: 67

[22] Filed: Jan. 2, 1987

[51] Int. Cl.[4] ..... A41D 45/10

[52] U.S. Cl. ..... 2/21

[58] Field of Search ..... 2/21, 158, 163, 159

[56] References Cited

U.S. PATENT DOCUMENTS 3,593,339 7/1971 Main ..... 2/21

4,573,220 3/1986 Baker ..... 2/21

*Primary Examiner*—Doris L. Troutman

*Attorney, Agent, or Firm*—A. A. Saffitz

[57] ABSTRACT

A finger protector for hair stylist's fingers, specifically useful to protect the inner first finger joint of the index and of the second finger of one hand from being pierced and cut by scissors used by the other hand during the cutting and styling of hair. The protector is formed as a unitary device and in one embodiment is glove-like having a larger finger end, a narrow wrist band end and an intermediate narrow joining portion which joins the larger finger end to the wrist end. In this glove-like protector only the wrist and the lower joint of the first two fingers are protected. In a second embodiment, the narrow wrist portion and the narrow joining portion are omitted, so that the unitary two-finger protector is fitted over the bottom knuckle up to the first knuckle of the index and second finger. In both first and second embodiments the two tubular finger portions have downwardly beveled open front portions and thickened front wall portions with an interconnecting web defining an angle between about 25° to about 35°. The protective device may be made of rubber, plastic, leather or of paper impregnated with a rubber binder.

11 Claims, 11 Drawing Figures

PROTECTIVE DEVICE FOR HAIR STYLIST'S FINGERS

BACKGROUND OF THE INVENTION

1. Field of the Invention

This invention is in the field of protective clothing devices, particularly finger and hand protectors which are specialized for particular work operations, especially cutting and hair grooming operations such as carried out by trained hair stylists and barbers which provide protection against accidental piercing or cutting by sharp pointed scissors or similar hair cutting implements.

2. Description of the Prior Art

Finger coverings and hand protectors have long been used to help the wearer in carrying out special operations either in work or in sports and their benefits are well known.

For example, Eckrode, in U.S. Pat. No. 923,118 describes a three finger rubber cot for use by a surgeon or physician in carrying out a gynecological examination or for use in exploring small wounds, mouth, throat, etc., to prevent exposing the physician to infection. A similar protector for the thumb and first two fingers is shown in French Patent No. 1106008 published Dec. 12, 1955.

Metal protectors for the finger tips, for the fingers and for the thumb have been described. For example, Ross, U.S. Pat. No. 1,314,098 describes individual finger type protector pieces which include prongs to help pick cotton, during removal of the cotton ball from the plant. Dougan, U.S. Pat. No. 1,916,921 discloses a metal thumb stall to protect the thumb from cuts in paring fruits and vegetables. Another obvious example is a thimble which protects the finger or thumb from being pierced by a sewing needle. A further example is a finger guard to protect against a knife used to cut and slice food such as described in Consigny, U.S. Pat. No. 4,507,804 which describes a single flexible guard member for the second finger. Still another example is a metal thumb clip to protect a manicurist while filing a person's nails as described in Shane, U.S. Pat. No. 1,783,984.

Gloves have been modified structurally to protect the palms of the hand or to gain a further skill in sports. For example a shock absorbing cyclist's glove is shown in Genz, European Patent No. 82 40 0618 in which the palm is padded. A glove for playing billiards as shown in Anast, U.S. Pat. No. 1,362,461 and in Baker, U.S. Pat. No. 4,573,220 to improve the player's skill. Also a protective glove for playing video games is disclosed in Chappell, U.S. Pat. No. 4,519,097 which clearly helps the game enthusiast in making rapid hand movements.

Special other protective devices have been proposed which involve less than all of the fingers. An example is the two finger stall used for picking fruit shown in Richardson, U.S. Pat. No. 1,642,311. Another example is a three finger protective device especially adapted for the upper finger joints of the middle fingers and used for archery as shown in Bellamy, U.S. Pat. No. 3,343,177. Another sports example is the two finger metal plate protector for bowling which is shown in Paige, U.S. Pat. No. 3,328,029.

Special cutaway gloves have been proposed to aid painstaking drawing operations, such as drafting, for example, in Main et al, U.S. Pat. No. 3,593,339, who shows a drafting glove for the little finger only. Also devices for serving food with the hands such as a triangular sheath glove is shown in Longstreth, et al, U.S. Pat. No. 2,751,592. This sheath is discarded after use and when used serves to grasp the food between the thumb, index finger and middle fingers without bringing the food into direct contact with the hands.

The prior art makes a distinction between protective gloves or glove-like devices which perform a very special function in the playing of sports and games from those in which the protective device or element is used to embrace a specific finger portion for carrying out a specific working task. An example can be seen in the Diggins U.S. Pat. No. 3,890,649 in which a special glove with an open top area is provided and in which all of the finger portions have been deleted, the remaining glove having the wrist portion, palm portion and a back portion for the hand. The glove structure in this patent provides a special stitching area at the open top in which truncated stalls are formed by stitches to accommodate the fingers and the thumbs. The teaching of this patent is that this construction will protect the fingers and the hands in such violent contact sports as football, where the players are very prone to finger and hand injuries.

An example of the special work protector used in cutting operations is found in Dougan, U.S. Pat. No. 1,916,921 showing a stall fitting over the top of the thumb to protect against cuts when peeling fruits and vegetables, or a similar stall in German Patent No. 578242 showing a thumb stall and an index finger stall to protect these when cutting vegetables.

None of these prior art devices is suitable to protect the hand of the hair stylist or barber who is manipulating sharp pointed scissors in one hand and exposes the other hand to inadvertent piercing or cutting by the tips of these scissors during the cutting of hair.

After long research the inventor has discovered that most beauticians, barbers and hair stylists suffer cuts and splits in only the first joint area of the first two fingers. These cuts occur during their training and during their working experience. The accidental cutting occurs quite frequently and not surprisingly when working under pressure or under conditions where the operator is suffering from fatigue. The inventor is familiar with those special fingerless gloves which are padded in the palm area and are worn by shoe repair workers when cutting the leather sole or heel parts with a sharp leather cutting knife in the other hand. The gloved hand is used to hold the shoe to which the sole part is fitted. Such fingerless gloves are not suitable to protect against the cuts and splits which occur while cutting hair for the reason that the protective device must leave the index and second fingers free to bend separately and leave the third and fourth fingers entirely open while the palm must be entirely open. During holding the hair, the third and fourth fingers are curled under the first two fingers. When a lock of hair is grasped in a lower layer, the operator may have to feel the length. All parts of the hand that can be open must be open and free to sense the hair by touch.

A glove which has been cut away in the finger portions to leave the first two joints of each finger exposed has been tried for cutting hair but is totally unsatisfactory because even with the thumb free, the hand holding the hair is so constrained that the operator can not manipulate the small strands of hair at the tips nor can the operator feel the lower layers of hair as required during the cutting operation.

The first attempt which was made by the inventor to provide a two-finger joint protector for the forefinger and the second finger utilized an elastic garter construction in which. the garter fabric formed a wrist band, a joining band and a separate two-finger stall was used. This device was wholly unsatisfactory, caused rubbing on the wrist, rubbing on the hand and insufficient flexibility at the first joint area below the knuckles of the digit finger and the second finger. The garter band was replaced by a rubber band construction but it was also unsatisfactory because of the rubbing action which the operator did not like. Indeed, in both the hand-band modification and the wrist band modification the user complained of intolerable chafing between the first and second fingers. Cuts were still made in both of these models by the scissors tips at the base of the first two fingers.

It was only when a critical angle of the web between the first and second fingers of the protector was provided, about 15° to 30° , that the special two finger protector became easy to use for cutting and free from chafing. It was only when the joint length between the lower knuckle portion for the forefinger and second finger and the first knuckle of these fingers was adjusted to free each first knuckle that an adequate protective device against cutting by the scissors tips was achieved. It was only when the inside of these joint protective portions was thickened that the protector assured that no piercing would take place.

SUMMARY OF THE INVENTION

A hair stylist's protective device for the first two finger joints which is formed of rubber, plastic, leather, or paper is provided. The remaining fingers, the palm, the back of the hand and the thumb are free. The first joints of the forefinger and second finger are protected by a unitary device encircling these portions of the forefinger and second finger. In one embodiment a wrist band and narrow joining portion is joined to the unitary joint protector.

In another embodiment the wrist band and joining band are deleted and the unitary joint protector is worn by inserting the fingers of the hand which is to be protected. The hand which wears this protective device is used by the hair stylist to grasp the tips of the hair being cut by scissors in the other hand. The portions of the forefinger and second finger covered by the unitary protective device protects these hand portions against cutting and piercing by the sharp tip of the scissors. The critical protective parts are shaped in the form of two joined open tubes with a web portion between, the web having an angle of 15° to 30°. The smaller top portion of the device is formed with the two separate finger tubes for the first joints of the index and second fingers. Each top of each tube is beveled downwardly. These finger ends which are open permit the forefinger and second finger to protrude freely at the fifst knuckle of each and to be movable for grasping, pulling, holding and arranging operations during the cutting. The advantage of the open finger structure is particularly apparent since the remaining fingers and thumb are entirely free which permits the entire thumb and remaining fingers to operate independently. This freedom of the third and fourth fingers and of the thumb permits these fingers to be free to move and the unobtrusiveness of the protector leads to better acceptance. The tip portions of the first two fingers are free which increases the sensitivity of the operator for sensing by touch, any unevenness in the cut ends or split ends of the hair and is of help to the operator in cutting.

The inventor has determined by survey that a large number of hair stylists experience cuts and splits in the finger areas even those operators who are very widely experienced. As many as 90% of all hair stylists have experienced cuts during their training. Most suffer cuts during periods when they have been very busy. The protective device of the invention has been used and found to be very efficient in preventing cuts and at the same time is easy to wear without irritating the finger portions where the lower joints of the fingers are covered. Most hair stylists have occasion to use many different kinds of sprays and solutions for hair care and particularly for permanent waves and often the finger and palm areas of the hand become irritated. The glove of the invention prevents such irritation by protecting against cuts to add to the trauma accompanying such irritation.

DESCRIPTION OF THE PREFERRED EMBODIMENTS

Figure 1:
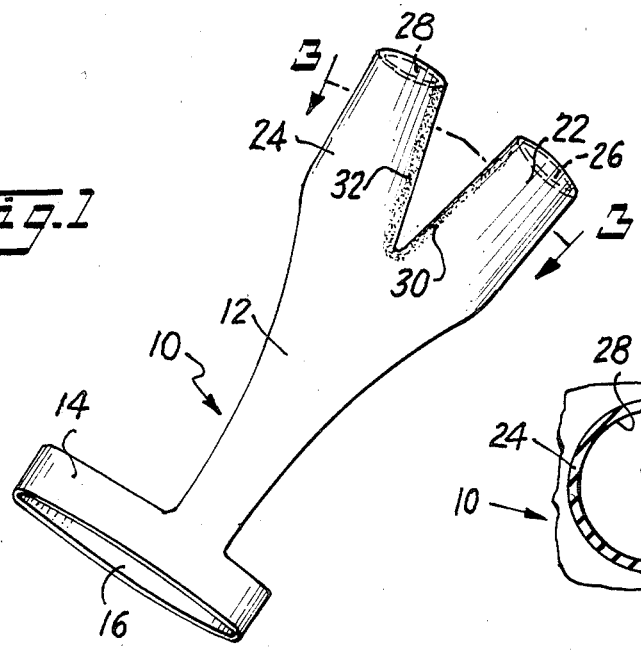
FIG. 1 is a pictorial view of a first embodiment of the invention showing a protective device for hair stylist's fingers.
Figure 1A:
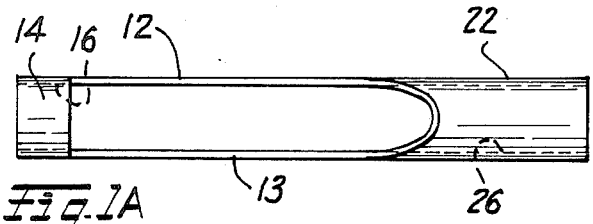
FIG. 1A is a side elevational view of the first embodiment of protective device for hair stylist's fingers shown in FIG. 1.
Figure 2:
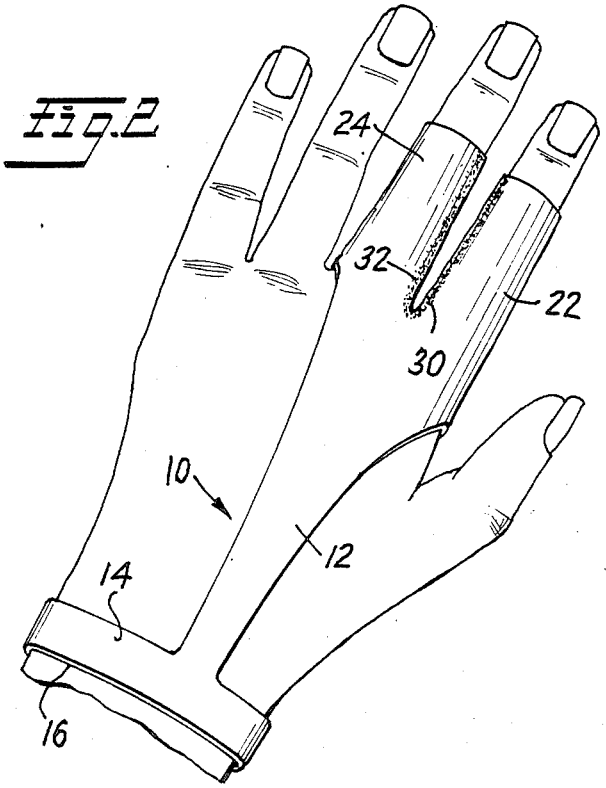
FIG. 2 is a plan view of the first embodiment of FIG. 1 shown on the hand of the hair stylist.

In FIGS. 1–6 inclusive a first embodiment of finger protector 10 for a hair stylist's fingers is shown comprising an open ended unitary two finger body consisting of an index finger protector 22 and a middle finger protector 24, a connecting leg 12 on the upper part of the finger body over the top of the hand, a connecting leg 13 on the lower part of the finger body over the central palm of the hand and a wrist band 14 around the wrist. The placement of the protector of FIG. 1 on the hand is shown in FIG. 2 and the relationship of the top leg 12 and bottom leg 13 to the index protector portion 22 and middle finger protector 24 is shown in FIG. 1A.

In the unitary open ended construction of the index finger protector 22 and middle finger protector 24 the distance between openings 26 and 28 and the bottom web where the protector fits is such that a divergent angle in the web in FIG. 1 shortens when the legs 12 and 13 are tightened by wrist band 14 as shown in FIG. 2.

The divergent angle shown in FIG. 1 which lies between the index finger protector 22 and the middle finger protector 24 measured from the bottom of the web as the vertex varies from about 25° to about 30°. When the device is put on the hand as shown in FIG. 2 and the web is pulled down, the angle decreases. This particular feature shown in FIG. 2 of decreasing the angle occurs because the upper leg 12 and the lower leg 13 serves as harrow connecting strips to pull the finger protector elements 24 and 22 downwardly at the base and wrist band 14 holds the protector tightly. Due to this holding action by the wrist band and the pulling action by the legs 12 and 13 at the top and bottom of the hand respectively pulling on the top and bottom protector surfaces simultaneously it is possible to use slightly larger finger sizes, e.g. finger diameter diameters for the openings of the index finger protector 22 and middle finger protector 24, namely openings 26 and 28 respectively.

It is contemplated that two or three different finger sizes or diameters will fit all fingers and due to the above pulling action described for the legs 12 and 13 and the holding action of the wrist band 14 in this first embodiment, a middle size may accommodate small as well as middle ranges of finger diameters. Accordingly it is possible that most commercial operators may be fitted by one size except for the occasional oversized fingers that can be encountered.

Figure 3:
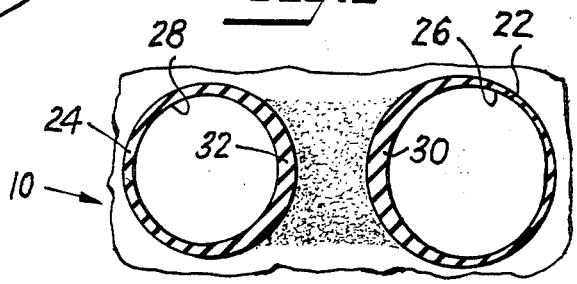
FIG. 3 is an enlarged fragmentary horizontal sectional view,taken on the line 3—3 of FIG. 2, showing the material of which the protector is made, namely rubber.
Figure 4:
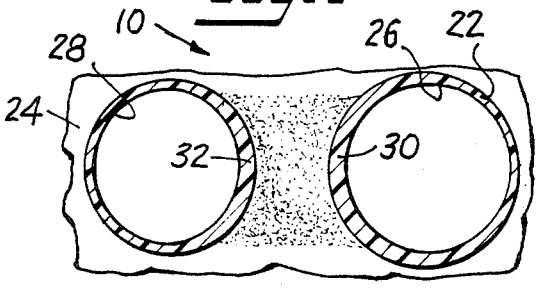
FIG. 4 is a view similar to FIG. 3 but showing a different material, polyvinyl chloride plastisol, rather than rubber, which is the material for the embodiment of FIG. 3.
Figure 5:
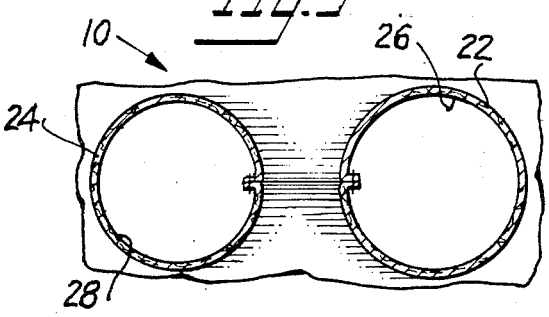
FIG. 5 is a view similar to FIG. 3 but showing a different material, leather, rather than rubber, which is the material for the embodiment of FIG. 3.
Figure 6:
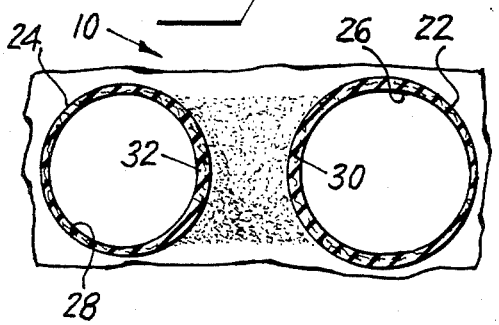
FIG. 6 is a view similar to FIG. 3 but showing a different material, paper impregnated with rubber, rather than rubber which is the material for the embodiment of FIG. 3.

It is an important characteristic of the invention that the inner finger protector portion of the index finger protector 22 and of the middle finger protector 24 be thickened and reinforced as shown in FIGS. 3 to 6. These areas are thickened at 30 in the inner portion of the index finger protector 22 and reinforced at 32 in the inner portion of the middle finger protector 24. It is contemplated that all structural embodiments of the invention, those shown in FIGS. 1–6 as well as those shown in FIGS. 7–9, will be made of a suitable material in appropriate thickness and these materials comprise rubber as shown in FIG. 3, which may be natural or synthetic, polyvinyl chloride plastisol in place of rubber as shown in FIG. 4, thin leather in place of rubber as shown in FIG. 5, or a crepe paper impregnated with rubber as shown in FIG. 6.

The rubber finger protector is made by conventional rubber latex manufacturing procedures as is commonly used for making rubber gloves and a preferred thickness guide is in a thickness of about 0.04 inch although it is possible to utilize thicknesses as high as 0.08 inch and as low as 0.025 inch.

A similar technique for plastic glove manufacture can be modified to make the finger protector by changing the mold to make only a portion of the elements of the glove deleting the tip portions of all of the remaining fingers and creating a narrow wrist band with modified leg portions.

Figure 10:
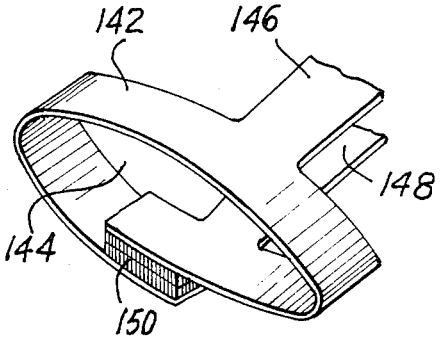
FIG. 10 is a perspective view of a modification of the wrist band of the protector of FIG. 1 to accommodate different wrist sizes by means of a hook and pile adjustable fastener.

In FIG. 10 a wrist band 142 is shown in which hook and pile fastening means 150 is provided at open ends of the wrist band to provide a reattachable portion of the band and thereby facilitate close fitting of the band. The band placed about the wrist by putting the hand through the opening 144 acts as an anchor to pull down the upper leg 146 over the top of the hand and the lower leg 148 over the bottom of the hand. The wrist band modification can be provided in any of the materials shown in FIGS. 3 through 6 inclusive. It is a characteristic of all of these modifications that the index finger opening 26 and middle finger opening 28 permit free movement of the joint above the first knuckle in the index finger and the middle finger so that these fingers may be freely used by the hair stylist in manipulating the hair during the cutting and styling operations.

In FIG. 5 where leather material is used and sewn, the seams are on the inside and split leather of very high grade and uniform thickness is used. All of the devices may be colored for the purpose of providing a better appearance to the protective device.

Figure 7:
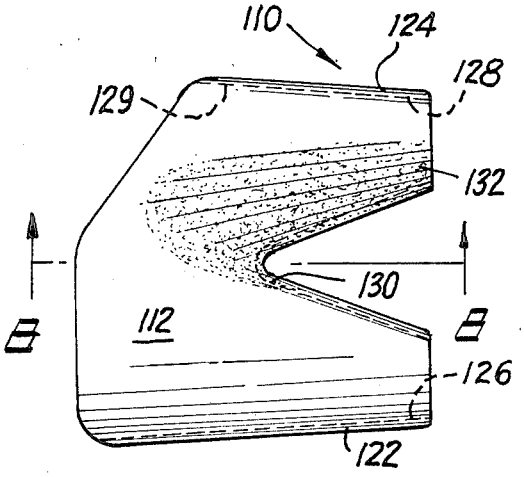
FIG. 7 is a top plan view of a second embodiment of protective device for hair stylist's fingers according to the invention.
Figure 8:
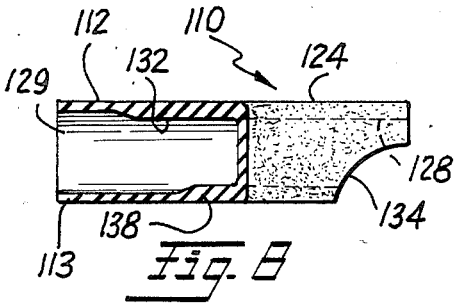
FIG. 8 is a vertical sectional view showing the thickened areas of the second embodiment, taken along line 8—8 of FIG. 7.
Figure 9:
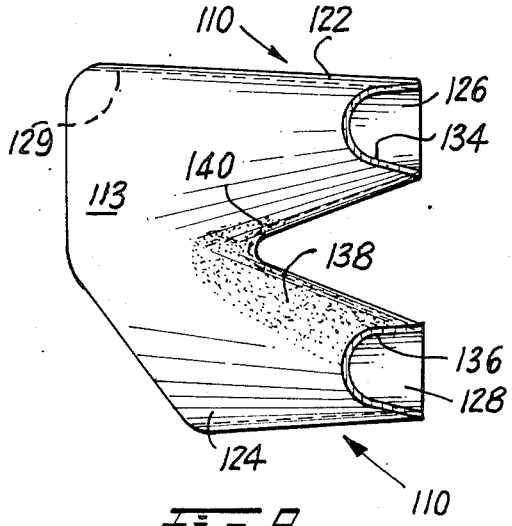
FIG. 9 is a bottom view of the second embodiment of FIG. 7.

In FIGS. 7 through 9 a second modification of finger protector 110 is shown in which a unitary structure is provided for the index finger protector 122 and middle finger protector 110 having a top surface 112, bottom surface 113, and there being provided an opening 126 in the index finger protector 122 and an opening 128 in the middle finger protector 124. The conformation of the opening 128 is shown at the bottom of FIG. 9 and there is a transverse cut and an inwardly curved cut 134 in the opening 126 which is the opening for the index finger. Similarly there is a transverse cut and an inwardly curved cut 136 at the lpening for the middle finger protector 124 shown in FIG. 9. The modification of the opening for the protector portions 122 and 124 adapt the protectors to lie over the knuckle portions and be cut backwardly at the knuckle joint of the index finger and the middle finger.

The web which is formed between the protector portions 122 and 124 at the base thereof forms an angle of about 30° to 35°. The opening at the bottom of the unitary body in the middle finger protector 124 presents a square or rectahgular edge at the bottom portion as shown in FIG. 9 whereas the bottom of the index finger protector 122 has a diagonal contour and adapts the unitary body to cling to the top of the hand and to the palm area when the protector is fit over the index finger and middle finger. It is seen from the taper of the protector at the side portions within the web and by the fit which results from this taper at the openings at the knuckles of each of the two fingers provides a holding encirclement by virtue of the cut out curvature at opening 134 and by the rounded conformation created by the angular bottom edge at the opening 129 and at the base of the index finger. A reinforcement similar to that which is provided in the first embodiment is achieved by thickening the protector 110 in area 130 of index finger protector 122 and by thickening or reinforcing area 132 of middle finger protector 124. Also the inner area of the middle finger protector is thickened and reinforced in area 138 as shown in FIG. 9. The unique aspects of this thickening can best be seen by considering the FIG. 7 and FIG. 9 views simultaneously. It is these areas of the fingers which need particular protection from the sharp points of the scissors which is used during the hair cutting operation.

The thickened area of the first embodiment of FIGS. 1–6 represented in rubber in FIG. 3, in polyvinyl chloride plastisol in FIG. 4, in leather in FIG. 5, and in paper impregnated with rubber in FIG. 6 (crepe paper), will, upon close examination, show that the inner finger area between the index finger and the middle finger of the protector members 22 and 24 are those areas which are thickened as represented by reference numerals 30 for the inner thickened portion of the index finger protector 22 and the reference numeral 32 for the thickened inner portion of the middle finger protector 24. These parts of the fingers which are contained within these protector portions 22 and 24 of FIG. 2 are particularly susceptible to be pierced by the tip of the scissors in the other hand of the operator. In the view of FIG. 5 the leather glove-like inner seamed protector portions 22 and 24 are shown without the thickened portion to emphasize the concept that leather which is more yieldable than rubber can provide protection without having the inner area thickened.

It is within the scope of the invention to insert a separate thin pad which can be adhesively attached or stitched in this area but leather as the material possesses this protective characteristic which makes it superior to the other materials.

The embodiments shown in FIGS. 7 through 10 have these inner finger areas likewise thickened and this is best shown at 132 in FIG. 8 and at 130 in FIG. 7. The cross sections which are described for and illustrated in FIGS. 3–6 can similarly be developed for FIGS. 7 through 9 with the same general stitching, namely, that the thickened areas 132 and 130 are specifically advantageous for a protector made of rubber or vinyl chloride plastisol or crepe paper which is impregnated with rubber latex binder. The provision of these thickened areas can be accomplished by ordinary manufacturing procedures as are used in latex glove manufacture. It is known to provide thickened areas by coating specific designated portions of gloves and in like manner, the present protector can be made on a suitable form with the thickened areas at 30 and 32 being provided by additional coating strips prior to stripping the product from the mold. A similar technique is used for vinyl-chloride plastisol as is used for rubber. The technique used for making a leather protector, e.g. cutting and sewing is that which is used for making the paper protector so that the manufacturing techniques of embodiments 5 and 6 are similar. The leather which is used is thin strip leather of high quality and is available in a thickness of 0.05 inch to 0.15 inch. The advantage of the thinner leather over the thicker leather skin is in the ease in which the pattern may be cut and the sewing made using appropriate fine strong thread, preferably miltifilament thread. The thickness of the paper sheet material used may vary from 0.03 to 0.20 inch but preferably varies between 0.03 to 0.10 inch. The thinner paper is easier to cutt and to form the seams. The seams may be formed by heat sealing after the pattern is cut. As in the case of the leather, inner thickened portions may be provided in separate cut out elements or pads. Thus an inner pad of 0.03 inch thickness raises the thickness at reference numeral 32 to 0.06 inch.

In the embodiment in FIGS. 7 through 9 and as particularly shown in FIGS. 8 and 9, the downwardly tapered openings 134 and 136 which are oriented in the inner palm area of the index finger and of the second finger permits the easy flexing of the fingers without having the protector edge bind and thereby impede movement of the index finger and the second finger. This is a very significant aspect of the novelty of the unitary two-fingered body portion which is adapted to keep the entire finger protector 110 in place so that the lower edge does not ride upwardly during use.

Having thus disclosed the invention, what is claimed is:

1. A finger protector for hair stylist's fingers useful to protect the index finger and second finger of one hand from being pierced and cut by scissors which are used in the other hand during the cutting and styling of hair, comprising:

an open ended two finger body having a lower open end portion, a web portion between the two fingers and an upper open end portion which extends from said lower end portion to cover the first knuckles of the index and second fingers;

said unitary two-fingered body portion being thickened on the inside for the index finger and the second finger; and said web portion between the index finger and the second finger separating these fingers at an angle between about 25° to about 35° to facilitate pulling said body over the index and second fingers over the knuckles and into the web between the two fingers in the palm area while permitting the remaining fingers and the thumb to curl below the index finger and second finger and to be completely exposed when the hair stylist grasps the tips of the hair for cutting.

2. A finger protector as claimed in claim 1 which may be worn on either the left hand or the right hand.

3. A finger protector as claimed in claim 1 wherein said protector is formed of rubber in a thickness of about 0.04 inch.

4. A finger protector as claimed in claim 1 wherein said protector is formed of a polyvinyl chloride plastisol material having a thickness of between 0.02 and 0.05 inch.

5. A finger protector as claimed in claim 1 wherein said protector is formed of thin leather.

6. A finger protector as claimed in claim 1 wherein said protector is formed of impregnated paper having a thickness of between about 0.03 and 0.10 inch and said paper is impregnated with a rubber latex binder.

7. A finger protector as claimed in claim 1 wherein said web separates said index finger and said second finger at an angle of about 30°–35°.

8. A finger protector as claimed in claim 1 including a wrist band and two connecting legs between the band and two fingered body, wherein said unitary two fingered body is integrally connected at its base by said legs at the top of the hand and at the bottom of the hand to said wrist band.

9. A finger protector as claimed in claim 8 wherein said web portion separates said index finger and second finger at an angle of about 25°–30°.

10. A finger protector as claimed in claim 7 wherein said wrist band is provided with a hook and pile fastening means to adjust the band to various wrist sizes.

11. A finger protector for hair stylist's fingers useful to protect the index finger and second finger of one hand from being pierced and cut by scissors which are used in the other hand during the cutting and styling of hair, comprising:

an open ended two finger body portion with each having a lower open end portion, a web portion between the two fingers and an upper open end portion, all of which cover the lower finger joints and inner and outer hand areas adjacent thereto;

said web portion between the index finger protector portion and second finger protector portion separating these finger protector portions at an angle between about 25° and about 35° thereby preventing the protector from riding up when the index finger and second finger are placed in the protector and said upper open part on each finger having a downwardly tapering cut on the inside to permit the fingers to flex.

* * * * *